US005556095A

United States Patent [19]

Stites

[11] Patent Number: 5,556,095

[45] Date of Patent: Sep. 17, 1996

[54] SHUFFLEBOARD GAME BOARD WITH A HANDICAP SCORING SYSTEM

[76] Inventor: Kelye Stites, 7100 Burns St., Richland Hills, Tex. 76118

[21] Appl. No.: 531,630

[22] Filed: Sep. 21, 1995

[51] Int. Cl.[6] ..... A63B 67/14

[52] U.S. Cl. ..... 273/126 R

[58] Field of Search ..... 273/126, 118 R, 273/108 R

[56] References Cited

U.S. PATENT DOCUMENTS 3,762,711 10/1973 Cooper ..... 273/126 R
3,992,009 11/1976 Trbovich ..... 273/126 R
4,348,026 9/1982 Kauffmann ..... 273/126 R
4,513,964 4/1985 Gunderson ..... 273/126 R
4,995,611 2/1991 Goldthorpe ..... 273/126 R X

*Primary Examiner*—Raleigh W. Chiu
*Attorney, Agent, or Firm*—Arthur F. Zobal

[57] ABSTRACT

The game board is an elongated rectangular shaped member having a top side. At each end, a series of axial scoring numbers 1, 2, 3, 4 and a series of lateral scoring numbers 1, 2, 3 are formed on the top side.

6 Claims, 1 Drawing Sheet

SHUFFLEBOARD GAME BOARD WITH A HANDICAP SCORING SYSTEM

BACKGROUND OF THE INVENTION

1. Field of the Invention

The invention relates to a board for the game of shuffleboard.

2. Description of the Prior Art

The game of shuffleboard as now played in game houses comprises an elongated rectangular board have a top side with the numbers 1, 2, and 3 formed at each end such that at each end the number 3 is located closest to the end, the number 2 located further from the end and the number 1 is located still further from the end with lateral lines formed between the 2 and 3 and between the 1 and the 2. The game is played with eight disk like pucks. Experienced shuffleboard players usually win and a handicap scoring system is needed.

SUMMARY OF THE INVENTION

It is an object of the invention to provide a new and useful board for the game of shuffleboard with a handicap scoring system.

In one embodiment, first and second number series having the numbers 1, 2, 3, and 4 are formed at opposite ends of the board with the number 4 being closest to the end, the number 3, is located further from the end, the number 2 is located still further from the end and the number 1 is located furtherest from the end. Third and fourth number series having the numbers 1, 2, and 3 are formed at opposite ends of the board with the number 3 being closest to the end, the number 2 being further from the end and the number 1 being furtherest from the end. The third series is spaced laterally from the first series and the fourth series is paced laterally from the second series. At opposite ends, lines are formed between the 1 and 2, 1; between the 2, 1 and 3, 2; and between the 3, 2 and 4, 3 respectively.

DESCRIPTION OF THE PREFERRED EMBODIMENT

Figure 1:
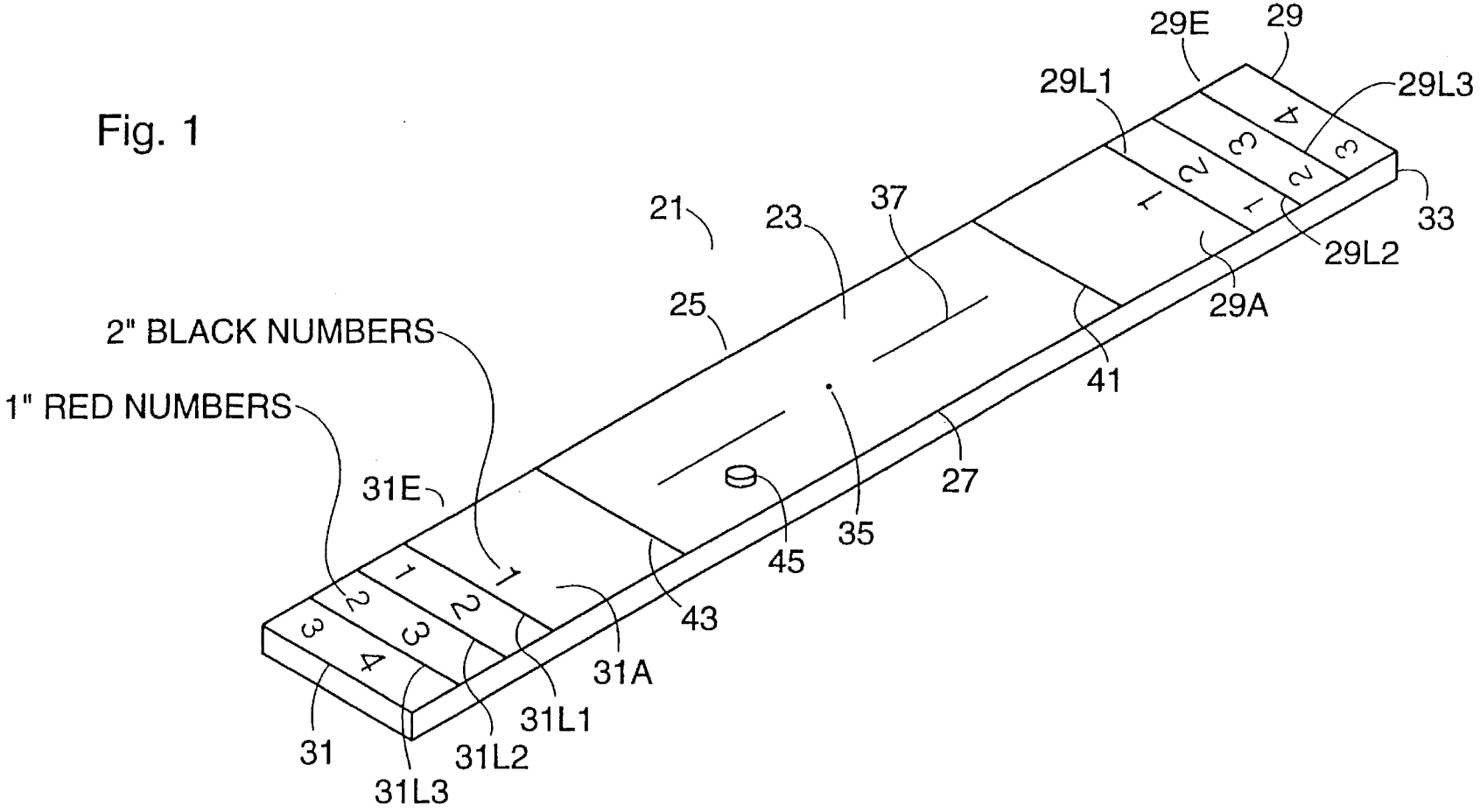
FIG. 1 is an isometric view of the game board of the invention.

Referring now to the drawing, the game board of the invention is identified at 21. It is an elongated member having a rectangular top side 23 with two elongated side edges 25 and 27, two end edges 29 and 31 transverse to the side edges 25 and 27 and a thickness 33. The mid point of the board between edges 29 and 31 is shown at 35. At the ends 29E and 31E are two numbering areas 29A and 31A wherein a series of spaced apart axial numbers 1, 2, 3 and 4 are formed on the top side and a series of spaced apart lateral numbers 1, 2, and 3 are formed. The axial numbers 1, 2, 3, 4 are formed along the elongated axis 37 of the board and the lateral numbers 1, 2, and 3 are formed in a line spaced laterally from the axis 37. At end 29E, lateral lines 29L1, 29L2, and 29L3 are formed between the numbers 1 and 2, 1, between the numbers 2, 1 and 3, 2, and between the number 3, 2 and 4, 3 respectively. At end 31E, lateral lines 31L1, 31L2 and 31L3 are formed between the numbers 1 and 2, 1, between the numbers 2, 1 and 3, 2 and between the numbers 3, 2 and 4, 3 respectively. Lines 29L1, 29L2, 29L3 and edge 29 are parallel to each other and perpendicular to side edges 25 and 27. Lines 31L1, 31L2, 31L3 and edge 31 are parallel to each other and perpendicular to side edges 25 and 27.

Boards of different lengths may be used. They are as follows:

| PLAYFIELD | LENGTH/SIZE |
|---|---|
| 22 | 20'8" |
| 20 | 18'8" |
| 18 | 16'8" |
| 16 | 14'8" |
| 15 | 13'8" |
| 14 | 12'8" |
| 12 | 10'8" |

The playfield includes a surrounding border, not shown. Although the lengths of the boards may vary, their widths will be the same i.e. 20 inches. Both ends of the shuffleboard table have three lines; 4, 3 line (29L3, 31L3) which is six inches from the end; the 3, 2 line (29L2, 31L2) which is twelve inches from the end; and the 2, 1 line (29L1, 31L1) which is 18 inches from the end. There are also two foul lines 41 and 43. For a 20'8" board, the foul lines 41 and 43 are six feet from the end. The axial numbers 1, 2, 3, 4 may be colored black and the lateral numbers 1, 2, 3 may be colored red. There are four disk shaped green pucks and four disk shaped red pucks. One puck is shown at 45. All pucks will have a diameter of 2⅞ inches. The board 21 may be formed of wood with the numbers and lines painted on the top surface and the top surface polished. The board will be supported by legs (now shown).

The rules of the game are as follows:

The object of the game is to score more points than your opponent by either knocking his pucks off or by sliding your puck past his into a higher score zone.

A typical game (partners or singles) is played to 15 points.

A coin toss determines who shoots first and who gets the hammer, the winner normally takes the hammer and loser picks the color of pucks he will shoot with. The last shot in a frame is called the hammer.

Player A manually shoots one of the pucks, then Player B manually shoots the other color and they rotate shots until all 8 pucks have been shot. If a puck does not cross the foul line closest to the player that is shooting, it must be removed and the shot is forfeited.

After all 8 pucks have been shot, the players determine who scored by counting only the pucks that are closest to the end of the table and are the same color. If a player has more than one puck closer to the end of the table than his opponent he may also count those pucks. Only one color can score per frame.

A puck must be completely inside the score zone to receive the points in the zone.

The team or player that scores in that frame must shoot first in the next frame. This process is repeated until one team or player reaches 15 points.

The purpose of Handicap Scoring is to allow players of different expertise play at an even level., similar to a golf handicap.

The axial numbers 1, 2, 3, 4 may be black and the lateral numbers 1,2, 3 may be red. The better team or player uses the red numbers and the other team or player uses the black numbers. Example: The more advanced player may receive 3 points for a particular shot whereas the other player would receive 4 points for the same shot.

Scoring for the red numbers is as follows:

A "1" would be a puck that is past the foul line closest to the shooter, but not past the 3, 2 line.

A puck which is a "2" would be completely past the 3, 2 line but not past the 4, 3 line.

A puck which is a "3" would have to be completely past the 4, 3 line but not extending over the end of the playing field.

A puck which is a "4" would be hanging over the end of the board and therefore is often referred to as a "hanger".

Scoring for the black numbers is as follows:

A "1" would be a puck that is past the foul line closest to the shooter, but not past the 2, 1 line.

A puck which is a "2" would be completely past the 2,1 line but not past the 3, 2 line.

A puck which is a "3" would have to be completely past the 3, 2 line but not past the 4, 3 line.

A puck which is a "4" would have to be completely past the 4, 3 line but not extending over the end of the playing field.

A puck which is a "5" would be hanging over the end of the board.

The puck must be completely inside the score zone to count in the higher zone.

It is to be understood that different points for the same shot into a score zone may be employed for handicap scoring. For example instead of 4-3-2-1 and 3-2-1 for the axial and lateral scoring numbers, the axial and lateral scoring numbers could be 5-4-3-2-1 and 4-3-2-1.

I claim:

1. A game board comprising:

an elongated rectangular board having a length and a width with two opposite elongated side edges and first and second opposite end edges which are transverse to said side edges, said board having a midpoint located between said first and second end edges, a first area located at said first end between said first end edge and a first position spaced between said midpoint and said first end edge, a second area located at said second end between said second end edge and a second position spaced between said midpoint and said second end edge, a first series of spaced apart number symbols being at least the numbers 1, 2, 3, 4 formed on said top side between said first position and said first end edge with each succeeding number of said first series from said first position being located closer to said first end edge, and having a greater magnitude than the preceding number, a second series of spaced apart number symbol being at least the numbers 1, 2, 3, 4 formed on said top side between said second position and said second end edge, with each succeeding number of said second series from said second position to said second end edge being located closer to said second end edge and having a greater magnitude than the preceding number, a third series of spaced apart number symbols being at least the number 1, 2, 3 formed on said top side between said first position and said first end edge and spaced laterally from said first series with each succeeding number of said third series being located closer to said first end edge and having a greater magnitude than the preceding number, a fourth series of spaced apart number symbols being at least the numbers 1, 2, 3 formed on said top side between said second position and said second end edge and spaced laterally from said second series with each succeeding number of said fourth series being located closer to said second end edge and having a greater magnitude than the preceding number.

2. The game board of claim 1, wherein:

said third and fourth series each has one number symbol less than that of said first and second series respectfully.

3. The game board of claim 2, wherein:

said 1, 2, and 3 of said third series are located at about the same positions from said first end edges as are said 2, 3, and 4 of said first series, said 1, 2, and 3 of said fourth series are located at about the same positions from said second end edge as are said 2, 3, and 4 of said second series.

4. The game board of claim 3, wherein:

a line extends between said two side edges between said 1 of said first series and said 2 and 1 of said first and third series, a line extends between said two side edges between said 2 and 1 of said first and third series and said 3 and 2 of said first and third series, a line extends between said two side edges between said 3 and 2 of said first and third series and said 4 and 3 of said first and third series, a line extends between said two side edges between said 1 of said second series and said 2 and 1 of said second and fourth series, a line extends between said two side edges between said 2 and 1 of said second and fourth series and said 3 and 2 of said second and fourth series, a line extends between said two side edges between said 3 and 2 of said second and fourth series and said 4 and 3 of said second and fourth series.

5. A game board comprising:

an elongated rectangular board having a length and a width with two opposite elongated side edges and first and second opposite end edges which are transverse to said side edges, said board having a midpoint located between said first and second end edges, a first area located at said first end between said first end edge and a first position spaced between said midpoint and said first end edge, a second area located at said second end between said second end edge and a second position spaced between said midpoint and said second end edge, a first series of spaced apart number symbols formed on said top side between said first position and said first end edge with each succeeding number symbol of said first series from said first position being located closer to said first end edge than the preceding number symbol, the magnitude of said number symbols of said first series progressively increases toward said first end edge, a second series of spaced apart number symbols formed on said top side between said second position and said second end edge, with each succeeding number symbol of said second series from said second position to said second edge being located closer to said second end edge than the preceding number symbol, the magnitude of said number symbols of said second series progressively increases toward said second end edge, a third series of spaced apart number series formed on said top side in said first area between said first position and said first end edge and spaced laterally from said first series with each succeeding number symbol of said third series being located closer to said first edge than the preceding number symbol, the magnitude of said number symbols of said third series progressively increases toward said first end edge, a fourth series of spaced apart number symbols formed on said top side in said second area between said second position and said second end edge and spaced laterally from said second series with each succeeding number symbol of said fourth series being located closer to said second end edge than the preceding number symbol, the magnitude of said number symbols of said fourth series progressively increases toward said second end edge.

6. The game board of claim 5, wherein:

said first number symbol of each of said series represents a one, said symbols of each of said series from its one number progressively increases in magnitude to the next whole number toward its associated end edge, said first and second series have the same number of number symbols, said third and fourth series have the same number of number symbols, said third and fourth series each has one number symbol less than that of said first and second series respectfully.

* * * * *